US005390485A

United States Patent [19]

Mori

[11] Patent Number: 5,390,485

[45] Date of Patent: Feb. 21, 1995

[54] PNEUMATIC TYPE SPINNING APPARATUS FOR REDUCING WASTE

[75] Inventor: Hideshi Mori, Jyoyo, Japan

[73] Assignee: Murata Kikai Kabushiki Kaisha, Kyowa, Japan

[21] Appl. No.: 20,129

[22] Filed: Feb. 19, 1993

[30] Foreign Application Priority Data

Feb. 19, 1992 [JP] Japan ..... 4-016266[U]

[51] Int. Cl.[6] ..... D01H 5/28; D02G 3/00

[52] U.S. Cl. ..... 57/328; 57/304; 57/315; 57/333; 57/350

[58] Field of Search ..... 57/289, 315, 328, 332, 57/333, 350, 341, 342, 343, 344, 5, 401, 408, 304, 305, 306

[56] References Cited

U.S. PATENT DOCUMENTS

| | | | |
|---|---|---|---|
| 3,487,619 | 1/1970 | Field | 57/328 |
| 4,107,911 | 8/1978 | Yamana et al. | 57/328 X |
| 4,412,413 | 11/1983 | Sakai et al. | 57/328 X |
| 4,958,487 | 9/1990 | Suganuma et al. | 57/328 |
| 5,090,192 | 2/1992 | Stahlecker | 57/333 X |
| 5,157,911 | 10/1992 | Stahlecker et al. | 57/333 X |
| 5,159,806 | 11/1992 | Mori et al. | 57/5 X |
| 5,193,335 | 3/1993 | Mori | 57/328 X |
| 5,211,001 | 5/1993 | Mori | 57/328 |
| 5,228,281 | 7/1993 | Stahlecker et al. | 57/328 |
| 5,243,813 | 9/1993 | Stahlecker | 57/315 X |

FOREIGN PATENT DOCUMENTS

| | | | |
|---|---|---|---|
| 2667618 | 4/1992 | France | 57/328 |
| 3104933 | 5/1991 | Japan | 57/333 |
| 3193922 | 8/1991 | Japan | 57/328 |

*Primary Examiner*—John M. Jillions
*Assistant Examiner*—William Stryjewski
*Attorney, Agent, or Firm*—Spensley Horn Jubas & Lubitz

[57] ABSTRACT

A draft device is provided with a rotatable porous roller and a suction tube for establishing a negative pressure within the porous roller. A pneumatic spinning apparatus is provided with a spindle and a nozzle for exerting a whirling air current on a fiber bundle from the draft device. A waste transport pipe is provided for circulating waste discharged from the spinning apparatus back to the porous roller. Waste discharged from the spinning apparatus is thereby recycled to join with the fiber bundle from the draft device.

6 Claims, 3 Drawing Sheets

PNEUMATIC TYPE SPINNING APPARATUS FOR REDUCING WASTE

BACKGROUND OF THE INVENTION

1. Field of the Invention

This invention relates to an apparatus in which a whirling air current is exerted on an untwisted short fiber bundle drafted by a draft device to twist it thereby producing spun yarns.

2. Related Art Statement

The present applicant has previously proposed a pneumatic type spinning apparatus for producing real twist spun yarns, which has been already filed separately (U.S. Pat. No. 5,159,806, etc.).

The aforesaid apparatus Is a spinning apparutus having a rotational or a non-rotational hollow spindle and a guide member which protrudes with an extreme end thereof directed at an inlet thereof, wherein a whirling air current is jetted toward the spindle inlet to twist a fiber bundle moved out of a draft device.

In the above-described conventional spinning apparatus, a proportion of waste discharged along with an air current with respect to a total amount of supplied fibers (a waste rate) is a few percent, which is uneconomical.

In the above-described conventional spinning apparatus, fibers fed out of the front rollers are sucked in an inlet portion of a spindle and are applied twists at an extreme end of a guide member since progation of twists toward the upper stream side is stomped at the extreme end of the guide member. So, in this spinning apparatus, splicing-off amount of short fibers from the transferring fiber bundle becomes large under the influence of the air current if the distance between the front rollers to the extreme end of the guide member is long. Accordingly, the produced yarn is really twisted but the distribution of length of fibers of the spun yarn tends to be deviated toward long fibers, and the spun yarn becomes quite different yarn from a ring spinning yarn. On the other hand, if the distance between the front rollers to the extreme end of the guide member is short (,for example, using the sliver of mean avarage of fiber length to be 25.2 mm and setting the distance between the nip point of front rollers to the extreme end of the guide member to be 16 mm), a bounded spun yarn shown in FIG. *6b* which comprises parallel core fibers and winding fibers is produced. During the process in which the fiber bundle transfers toward the extreme end of the guide member, breakage of fibers occurs and the rate of splicing-off of short fibers is 1.5%.

SUMMARY OF THE INVENTION

An object of this invention is to make the waste rate in the pneumatic type spinning apparatus substantially zero.

In the method in which a whirling air current is exerted on an untwisted fiber bundle drafted by a draft device to twist it thereby producing spun yarns, it is another object of this invention to produce a spun yarn having yarn construction to be similar to a ring spinning yarn.

For achieving the aforesaid object, the present invention provides a spinning apparatus comprising a draft device comprising a porous roller which is rotated when a negative pressure is applied to one of rollers; a pneumatic type spinning apparatus comprising a nozzle block having a nozzle for exerting a whirling air current on a fiber bundle moved out of said draft device, a rotational or non-rotational spindle and a guide member which protrudes with an extreme end thereof directed at an inlet of said spindle; and a waste transport pipe for circulating a waste discharged from said pneumatic type spinning apparatus to said porous roller.

Furthermore, the present invention provides a spinning method including steps of feeding a fiber bundle from a draft device including a porous roller, which is applied a negative pressure, around a guide member protruding an extreme end thereof toward an inlet of a spindle, jetting a whirling air current near the inlet of the spindle to twist the fiber bundle, and circulating an exhaust jetted air to said porous roller.

In the spinning apparatus configured as described above, a fiber bundle moved out of a draft device is drawn into the apparatus by the action of an air current jetted out of a nozzle, and front ends of all fibers of the fiber bundle are drawn by the fiber bundle being formed into a yarn from the periphery of a guide member and guided into aspindle. And, the rear ends of the fibers are invented from the spindle inlet and separated into fibers.

The separated fibers at the rear end are exposed to the whirling air current jetted out of the nozzle and spirally wound about the fiber bundle being formed into a yarn as the yarn runs to form a real twist spun yarn. On the other hand, the waste discharged out of the pneumatic type spinning apparatus is returned to the surface of the porous roller by the negative pressure applied to the porous roller and joins with the fiber bundle being drafted for reuse.

FIGS. *6a* and *6b* are views illustrating appearance of a yarn obtained according to a spinning method of this invention and appearance of a yarn obtained according to a conventional spinning method, respectively.

DETAILED DESCRIPTION OF PREFERRED EMBODIMENT

Figure 1:
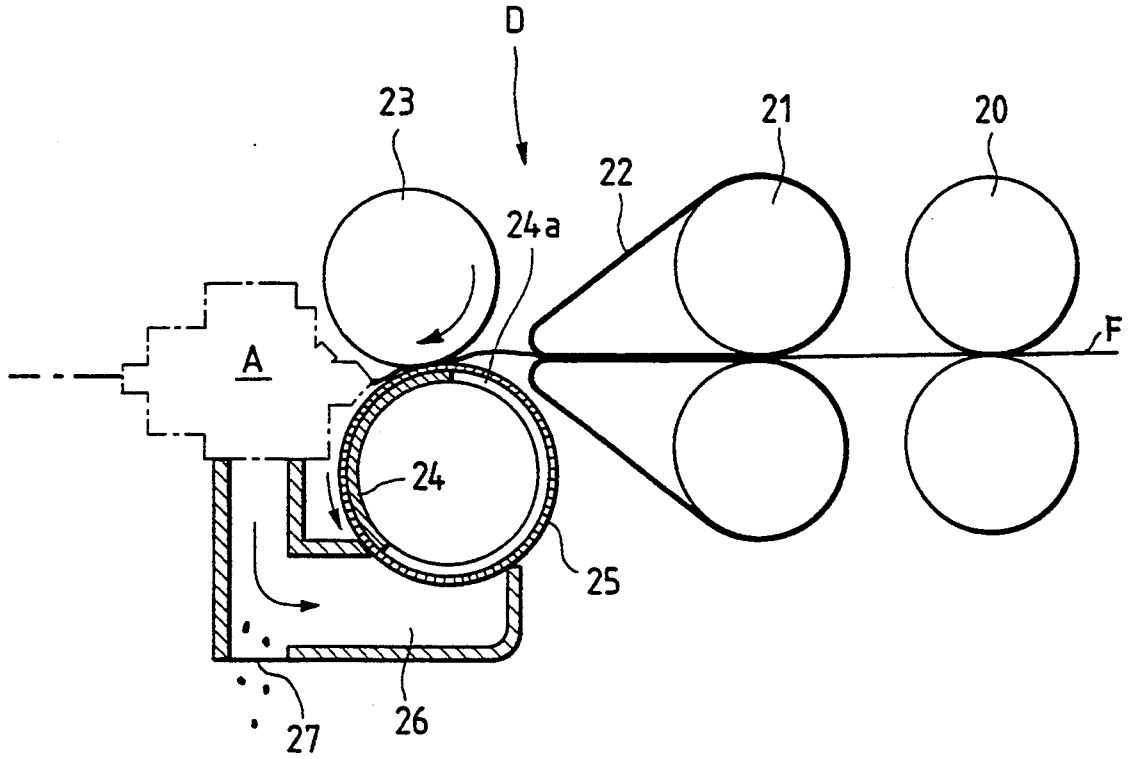
FIG. 1 is a side view with a part of a draft device in a spinning apparatus according to this invention sectioned.
Figure 2:
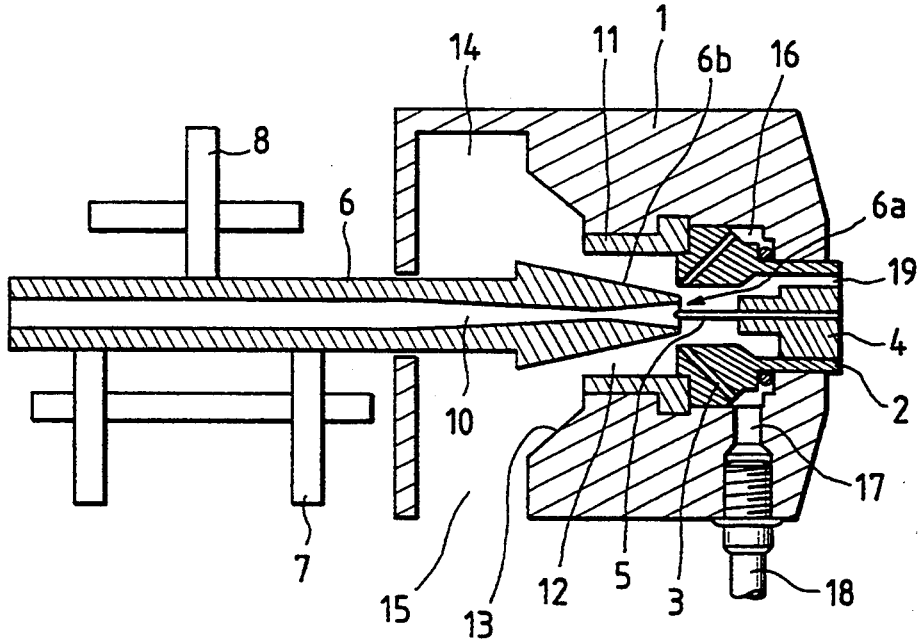
FIG. 2 is a sectional view of a pneumatic type spinnig apparatus in a spinning apparatus according to this invention.

The spinning apparatus according to this invention will be described hereinbelow with referrence to FIGS. 1 and 2.

This spinning apparatus comprises a draft device D comprising a back roller 20, a middle roller 21 having an apron and front rollers (23–25); a pneumatic spinning device A arraged next to the draft device D; and a waste transport pipe 26 for circulating a waste discharged out of the pneumatic spinning device A.

The pneumatic spinning apparatus A is arranged interiorly of a casing 1 and comprises a nozzle block 2 having a nozzle 3, a guide member support 4 fixed therein and having a guide member 5, and a rotational spindle 6 whose inlet side is inserted into the casing 1.

The spindle 6 is surrounded by rollers 7 and 8 and a third roller (which third roller is provided on this side of FIG. 1 and which is not shown) and circumscribed and supported by bearings, one out of which is a driving roller. A fiber bundle passage 10 is formed to extend through the center of the spindle 6. An outside diameter of an inlet 6*a* is sufficiently small, and a portion continuous to the inlet 6*a* is formed into a conical portion 6*b* whose outside diameter increases toward a downstream side.

A portion covering the spindle 6 of the casing 1 is that a portion in the vincinity of the spindle inlet 6*a* is a small-diameter cylindrical hollow chamber 12 by a bush 11, and a portion continuous to the hollow chamber 12 is a conical hollow chamber 13 opened at a large angle. A portion forwardly of the small-diameter hollow chamber 12 is cylindrical which is slightly large in diameter than a diameter of the extreme end of the spindle 6 by the nozzle block 2. The conical hollow chamber 13 is formed on this side with an annular hollow chamber 14 and a trangential air escape hole 15 continuous thereto. A waste transport pipe 26 is connected to the air escape hole 15.

The casing 1 is interiorly formed with a hollow air reservoir 16 adjacent to the nozzle block 2. The nozzle block 2 is formed with four air jet nozzles 3 which are communicated with the air reservoir 16, directed downstream slightly away from the inlet 6*a* of the spindle 6 and selected tangentially with respect to the hollow chamber 12. An air hose 18 is connected to the air reservoir 16 through a hole 17. The direction of the nozzle 3 is set to the same direction as the rotating direction of the spindle 6.

Compressed air supplied from the hose 18 flows into the air reservoir 16 and thereafter jetted into the hollow chamber 12 from the nozzle 13 to generate a high speed whirling air current in the vicinity of the spindle inlet 6*a*. This current whirls whithin the hollow chamber 12 and thereafter scatters outwardly whirling gently within the conical hollow chamber 13 and is then guided toward the escape hole 15 for discharge. Currently, this air current generates a suction air current which flows a nip point of the front roller into the hollow portion of the casing 1.

The guide member support 4 is columnar in which a small-diamater columner portion is protruded at one end, and one side thereof is cut to form a gap 19 adjacent to the nozzle block 2 so as to serve as a guide passage for the fiber bundle. A small diameter hole registered with a center line of the passage 10 of the spindle 6 is bored lengthwise of the guide member support 4, and a pin-like guide member 5 is inserted into the small diameter hole.

The guide member 5 protrudes from the small diameter hole of the guide member support 4 to render the extreme end free so as to face to the inlet 6*a* of the spindle 6.

The front roller of the draft device D is composed of a rubber top roller 23, a porous roller 25 arranged below the top roller 23 and driving the top roller 23, and a non-rotational suction tube 24 arranged therein.

The porous roller 25 has numberless small holes of approximately 20 microns and supported on the hollow suction tube 24 leaving a slight gap from the outer surface of the suction tube 24. The suction tube 24 is formed peripherally with an air suction opening 24*a* of predetermined length. Accordingly, air drawn by the suction tube 24 is drawn by the air suction hole 24*a*. The roller constituted by the porous roller and the suction tube may be any roller of the draft device D, and in any case, an outlet portion of the waste transport pipe 26 is communicated with the porous roller.

Finally, in this spinning apparatus, the waste transport pipe 26 is connected between (the air escape hole 15 of) the pneumatic type spinning apparatus A and the porous roller 25 in the top roller. This waste transport pipe 26 is bended into an L-shape, bended portion of which is opened at 27. The suction air current by the suction tube 24 reaches the waste transport pipe 26, whithin which a flow of air and waste occurs. At that time, foreign matter such as -leaves having a mass fall through the opening 27 of the banded portion, and only the fibers are carried to the surface of the porous roller 25.

In the configured spinning system, the fiber bundle drafted by the draft device is drawn into the casing 1 from the gap 19 between the nozzle block 2 and the guide member support 4 by the action of the air current jetted out of the nozzle 3, and the front ends of all fibers of the fiber bundle are drawn by the fiber bundle being formed into a yarn and guided into the spindle from the periphery of the guide member 5. The rear end side of the fiber is inverted from the spindle inlet 6*a* and separated into fibers. The fiber separated at the rear end is exposed to the whirling air current jetted out of the nozzle 3 and spirally wound about the fiber bundle being formed into a yarn to form a real twist spun yarn. On the other hand, the floating fiber discharged from the air escape hole 15 through the waste transport pipe 26 is returned to the surface of the porous roller 25 by the suction negative pressure of the suction tube 24 within the porous roller 25 and joins the fiber bundle being drafted for reuse. The guide member 5 impedes a propagation of twist during forming a yarn or temporarily performs a function of a center fiber bundle, so-called a false core. The guide member 5 has a function to impede the formation of an untwisted core fiber bundle remarkably appearing in the conventional pneumatic type bundle spun yarn to form a yarn merely by the wound fiber in fact.

It is noted that the spindle 6 assists applying a twist to a yarn. Even if the spindle 6 is not rotated, a yarn can be produced depending on the kind thereof. Accordingly, the spindle 6 need not always be rotated.

Being construced as described above, the present invention has advantageous effects as described below.

It is possible to produce yarns which has a large amount of wound fibers and by no means inferior to ring yarns in external appearance as well as strength characteristics. Further, since wastes to be discharged are circulated to the draft device making use of negative pressure applied to the porous roller, not only the waste rate can be rendered substantially zero but also the fiber bundle being drafted is not disturbed. Accordingly, no uneven yarn occurs. Moreover, in the case where a porous roller is used as a front roller, no air current resulting from high speed rotation occurs, and an adverse influence thereof can be avoided.

The spinning method according to this invention will be described with reference to FIGS. 3 to 6.

This spinning method fundamentally comprises steps of feeding a drafted fiber bundle around a guide member 105 of which extreme end is protruded toward a spindle inlet 106*a*, and jetting a whirling air current near the spindle inlet 106*a* to spun out a yarn. Furthermore, a porous roller 125 which is applied a negative pressure is used as one of front rollers consisting of a draft device. Weak restricting force is applied to rear ends of fibers of the supplied fiber bundle by means of the porous roller 125 and exhaust gas of the whirling air current is returned to the porous roller 125.

This spinning apparatus for embodying the spinning method of this invention comprises a draft device D comprising a back roller 120, a middle roller 121 having an apron and front rollers (123–125); a pneumatic spinning device A arranged next to the draft device D; and a waste transport pipe 126 for circulating a waste discharged out of the pneumatic spinning device A.

The pneumatic spinning apparatus A is arranged interiorly of a casing 101 and comprises a nozzle block 102 having a nozzle 103, a guide member support 104 fixed therein and having a guide member 105, and a rotational spindle 106 whose inlet side is inserted into the casing 101.

A fiber bundle passage 107 is formed to extend through the center of the spindle 106. An outside diameter of an inlet 106*a* is sufficiently small, and a portion continuous to the inlet 106*a* is formed into a conical portion 106*b* whose outside diameter increases toward a downstream side.

A portion covering the vicinity of the spindle inlet 106*a* of the nozzle block 102 is formed to be a small-diameter cylindrical hollow chamber 108 and a portion at the upstream side of the hollow chamber 108 is cylindrical which is slightly large in diameter than a diameter of the extreme end of the spindle 106 by the nozzle block 102. A portion continuous to the hollow chamber 108 is formed with an annular hollow chamber 109 and a tangential air escape hole 110 continuous thereto. A waste transport pipe 126 is connected to the air escape hole 110.

The upper casing 101*b* is interiorly formed with a hollow air reservoir 111 adjacent to the nozzle block 102. The nozzle block 102 is formed with four air jet nozzles 103 which are communicated with the air reservoir directed downstream slightly away from the inlet 106*a* of the spindle 106 and directed tangentially with respect to the hollow chamber 108. An air hose not shown is connected to the air reservoir 111 through a hole 112. The direction of the nozzle 103 is set to the same direction as the rotating direction of the spindle 106.

Compressed air supplied from the hose flows into the air reservoir 111 and thereafter jetted into the hollow chamber 108 from the nozzle 103 to generate a high speed whirling air current in the vicinity of the spindle inlet 106*a*. This air current whirls within the hollow chamber 108 and thereafter scatters outwardly while whirling gently within the conical hollow chamber 109 and is thence guided toward the escape hole 110 for discharge. Concurrently, this air current generates a suction air current which flows from a nip point of the front roller into the hollow portion of the casing 101.

The guide member support 104 is a cap-like member of which one side facing to the porous roller 125 consisting of the front rollers mentioned hereinafter is cut to form a guide passage 113 for the fiber bundle, and a pin-like guide member 105 is secured at the center of the guide member support 104.

The guide member 105 protrudes from the center of the guide member support 104 to render the extreme end free so as to face to the inlet 106*a* of the spindle 106.

A driving section of the spindle is supported by an air bearing within a bearing casing 114 and is driven by an air turbine. The air bearing is provided with a cylindrical bush 117 having an air jetting hole 117*b* continuous to an air reservoir 117*a* and fitted within the bearing casing 114, and a compressed air supply hole 114*c* which is continuous to the air reservoir 117*a* is provided in the bearing casing 114. The numeral 118 designates a cap for the bearing casing 114.

In this air bearing, when the compressed air is supplied to the air bearing from a hose pipe not shown continuous to the compressed air supply hole 114*c*, the compressed air is discharged out through the air reservoir 117*a*, the air jetting hole 117*b* and the clearance between the spindle 106 and the bush 117 so that the spindle 106 becomes not to be contacted with the bush 117.

The cylindrical bush 116 having the compressed air supply hole 116*a* opening in the tangential direction and an air discharging hole 116*b* is fitted within the bearing casing 114, and the compressed air supply hole 114*a* and the air discharging hole 114*b*, which are continuous to the compressed air supply hole 116*a* and the air discharging hole 116*b*, respectively, are provided in the bearing casing 114. A plurality of semi-circular concave portions 106*c* are formed on the outer circumference of the spindle 106 at the position corresponding to the opening of the compressed air supply hole 116*a* to receive the air current jetted from the compressed air supply hole 116*a*.

In this turbine, when the compressed air is supplied from the hose pipe (not shown) continuous to the compressed air supply hole 114*a*, the compressed air collides against the concave portion 106*c* of the spindle 106 through the compressed air supply hole 106*a* to rotate the spindle 106. The air current for rotating the spindle 106 is discharged out through the air discharging holes 116*b* and 114*b*.

It is noted that the spindle 106 assists applying a twist to a yarn. Even if the spindle 106 is not rotated, a yarn can be produced depending on the kind thereof. Accordingly, the spindle 106 need not always be rotated.

The front roller of the draft device D is composed of a rubber top roller 123, a porous roller 125 arranged below the top roller 123 and driving the top roller 123, and a non-rotational suction tube 124 arranged therein.

The porous roller 125 has numberless small holes of approximately 20 microns and supported on the hollow suction tube 124 leaving a slight gap from the outer surface of the suction tube 124. The suction tube 124 is formed peripherally with an air suction opening 124*a* of predetermined length. Accordingly, air drawn by the suction tube 124 is drawn by the air suction hole 124*a*.

Figure 5:
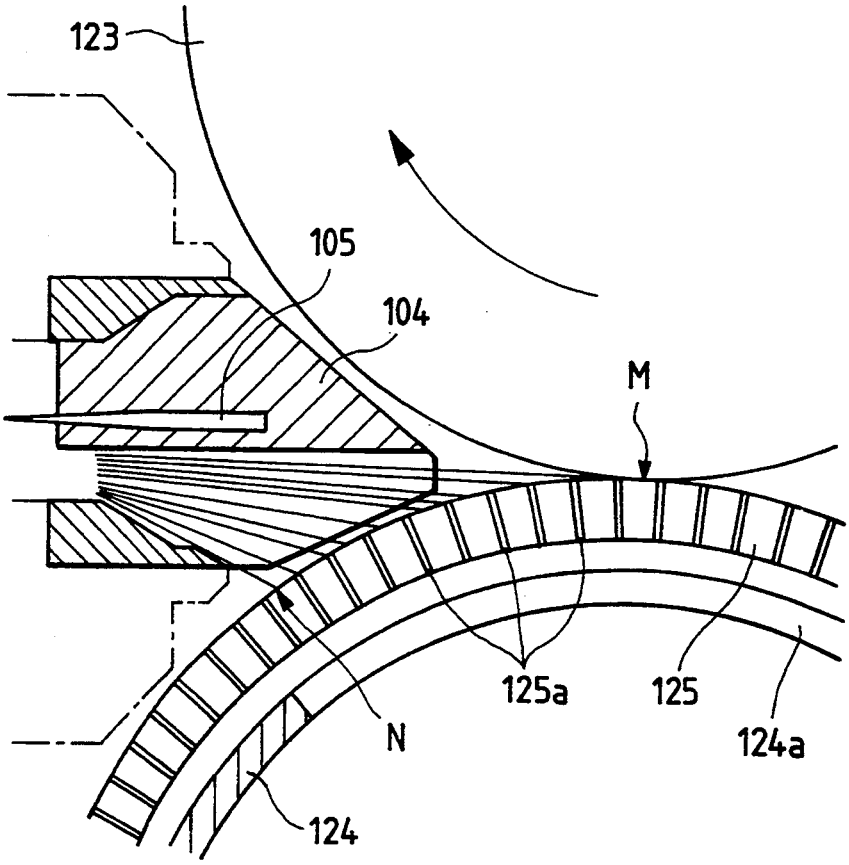
FIG. 5 is a sectional view showing the vicinity of an inlet of the pneumatic type spinning apparatus in FIG. 4.

As shown in FIG. 5, the distance between the extreme end of the guide member 105 to N point is shorter than the distance between the extreme end of the guide member 105 to the nip point M of the front rollers. So, the rear ends of most of the fibers moved out of the front rollers are sucked by the porous roller and weakly caught thereby, are moved from M point to N point in this state, and then the fibers are sucked toward the extreme end of the guide member 105. Accordingly, the fibers moved out of the front rollers are arranged substantially straight and are adequately separated so that reversed movement of the rear end of the fibers in the subsequent step becomes easily and the disturbance of fibers due to the air current flowed in from the inlet of the spinning apparatus may be avoided. This advantage may be attained if the distance between the nip point M to the extreme end of the guide member 105 becomes long within a certain range. Thus, splicing-off of the short fibers can be prevented, uneveness of yarn thickness is decreased, and the yarn strength is improved. Furthermore, breakage of fibers moving between the nip point M of the front rollers and the extreme end of the guide member 105 may be prevented by setting the distance between the extreme end of the guide member 105 and the nip point M to be long in a certain range.

Figure 3:
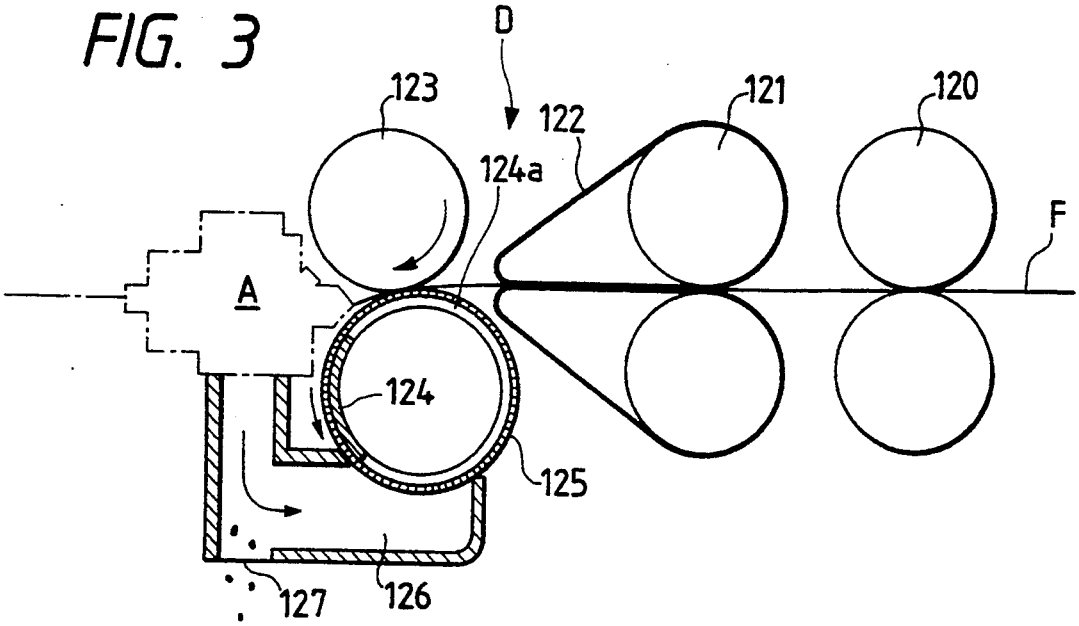
FIG. 3 is a side view with a part of a draft device of a second embodiment of this invention sectioned.
Figure 4:
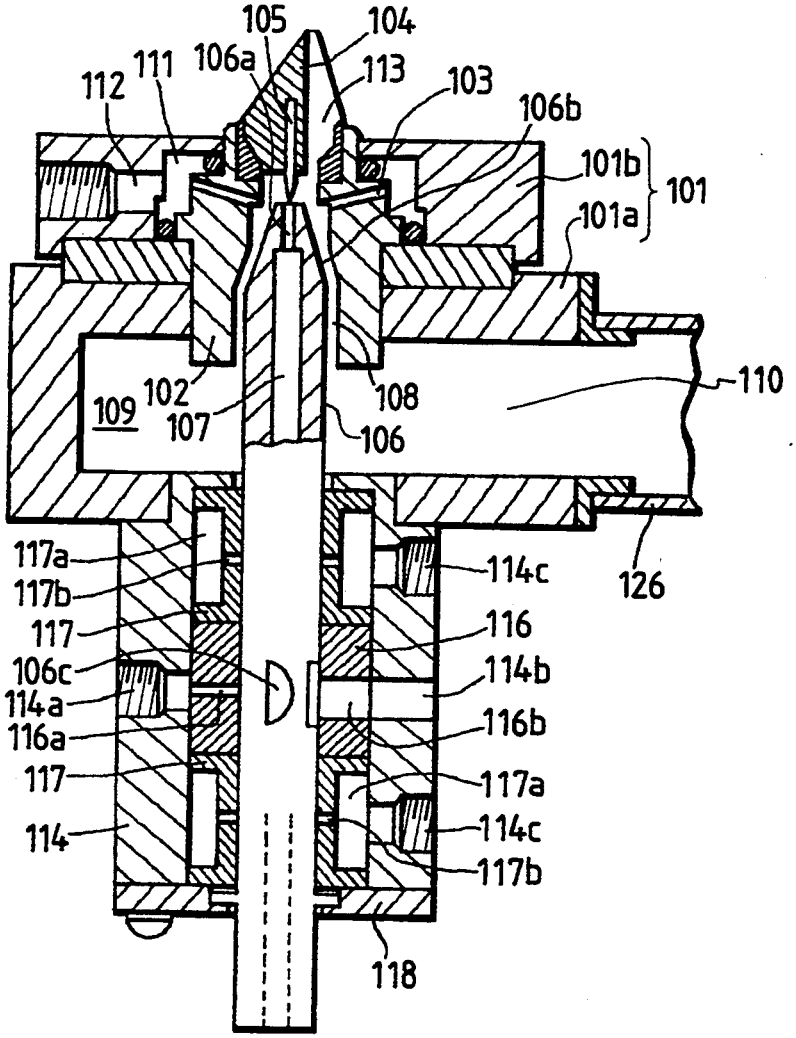
FIG. 4 is a sectional view of a pneumatic type spinning apparatus of the second embodiment.

Finally, in this spinning apparatus, the waste transport pipe 126 is connected between (the air escape hole 110 of) the pneumatic type spinning apparatus A and the porous roller 125 in the top roller as shown in FIG. 3. This waste transport pipe 126 is bended into an L-shape, bended portion of which is opened at 127. The suction air current by the suction tube 124 reaches the waste transport pipe 126, within which a flow of air and waste occurs. At that time, foreign matter such as leaves having a mass fall through the opening 127 of the bended portion, and only the fibers are carried to the surface of the porous roller 125.

In the thus configured spinning system, the fiber bundle drafted by the draft device is drawn into the casing 101 through a fiber bundle introducing hole 113 by the action of the air current Jetted out of the nozzle 103, and the front ends of all the fibers of the fiber bundle are drawn by the fiber bundle being formed into a yarn and guided into the spindle from the periphery of the guide member 105. The rear end side of the fiber is moved being sucked by the porous roller 125 and is affected by the force of air current jetted from the nozzle 103 in the axial direction thereof when the fiber passes over the porous roller 125. The rear end side of the fiber is inverted from the spindle inlet 106*a* and separated into fibers. The fiber separated at the rear end is exposed to the whirling air current jetted out of the nozzle 103 and spirally wound about the fiber bundle being formed into a yarn to form a real twist spun yarn. On the other hand, the floating fiber discharged from the air escape hole 110 through the waste transport pipe 126 is returned to the surface of the porous roller 125 by the suction negative pressure of the suction tube 124 within the porous roller 125 and Joins with the fiber bundle being drafted for reuse. The guide member 105 impedes a propagation of twist during forming a yarn or temporarily performs a function of a center fiber bundle, so-callled a false core. The guide member 105 has a function to impede the formation of an untwisted core fiber bundle remarkably appearing in the conventional pneumatic type bundle spun yarn to form a yarn merely by the wound fiber in fact.

Figure 6A:
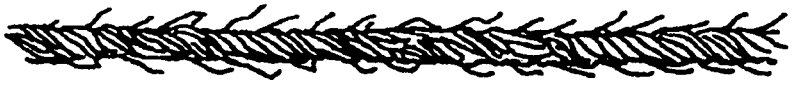
Figure 6B:
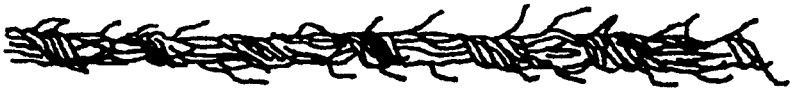

According to the spinning method of this invention, a yarn is spun out by using the sliver of mean average of fiber length to be 25.2 mm and setting the distance between the nip point of the front rollers to the extreme end of the guide member 105 to be 20 mm. The produced yarn is really twisted yarn as shown in FIG. 6*a* and is quite similar to the ring yarn. The rate of splicing-off of short fibers is 0.8% and is quite less. So, it is supposed that the distribution of fiber length in the spun yarn of this invnetion will be substantially same as that in the ring yarn.

This invention is constituted hereinbefore mentioned and attains following effects.

Accordingly to the present invention, a spun yarn which is extremely similar to the ring yarn in an appearance, distribution of fiber length and yarn strength characteristic can be produced, and loss of fibers is decreased to half compared with the conventional spinning method. The distance between the nip point of the front rollers to the extreme end of the guide member may be set to be rather long in a certain range so that breakage of fibers moving therebetween may be prevented.

What is claimed is:

1. An apparatus comprising:

a draft device, the draft device comprising a rotatable porous roller and means for establishing a negative pressure within the porous roller, a pneumatic spinning device, the pneumatic spinning device comprising a nozzle block having a nozzle for exerting a whirling air current on a fiber bundle from the draft device, a spindle having an inlet, and a guide member directed toward the inlet of the spindle, and a waste transport pipe for circulating only fibers discharged from the spinning device to the porous roller in an air flow generated by the negative pressure in the porous roller, whereby fibers discharged from the spinning device are recycled to join with the fiber bundle from the draft device.

2. The apparatus of claim 1, wherein the draft device comprises a plurality of front rollers and wherein the porous roller comprises at least one of the front rollers of the draft device.

3. The apparatus of claim 2, wherein at least one of the front rollers comprises a rubber roller, wherein the porous roller is arranged for driving the rubber roller, and wherein the means for establishing a negative pressure within the porous roller comprises a substantially stationary suction tube arranged within the porous roller.

4. The apparatus of claim 1, wherein the porous roller has an inner diameter and a plurality of holes, each of the holes being approximately 20 microns in size, wherein the means for establishing a negative pressure within the porous roller comprises a substantially hollow suction tube arranged within the porous roller, the hollow suction tube having an outer diameter which is spaced from the inner diameter of the porous roller to thereby establish a gap between the outer diameter of the hollow suction tube and the inner diameter of the porous roller, and wherein the hollow suction tube has an air suction opening of predetermined length.

5. A method comprising:

providing a draft device having a porous roller, providing a spinning device having a guide member and a spindle having an inlet, establishing a negative pressure within the porous roller, feeding a fiber bundle from the draft device around the guide member toward the inlet of the spindle, jetting a whirling air current near the inlet of the spindle to twist the fiber bundle, and circulating only fibers discharged from the spinning device to the porous roller in an air flow generated by the negative pressure within the porous roller.

6. An apparatus comprising:

a draft device, the draft device comprising a rotatable porous roller and means for establishing a negative pressure within the porous roller, a pneumatic spinning device, the pneumatic spinning device comprising a nozzle block having a nozzle for exerting a whirling air current on a fiber bundle from the draft device and means for impeding propagation of twist during yarn formation, and a waste transport pipe for circulating only fibers discharged from the spinning device to the porous roller in an air flow generated by the negative pressure in the porous roller, whereby fibers discharged from the spinning device are recycled to join with the fiber bundle from the draft device.

* * * * *